United States Patent [19]

Eguchi et al.

[11] Patent Number: 4,466,370

[45] Date of Patent: Aug. 21, 1984

[54] ZIGZAG HEMSTITCH

[75] Inventors: Yasukata Eguchi; Susumu Hanyu, both of Tokyo, Japan

[73] Assignee: Janome Sewing Machine Co. Ltd., Tokyo, Japan

[21] Appl. No.: 340,729

[22] Filed: Jan. 19, 1982

[30] Foreign Application Priority Data

Jan. 19, 1981 [JP] Japan ..... 56-4994

[51] Int. Cl.[3] ..... D05B 1/20

[52] U.S. Cl. ..... 112/269.1; 112/441

[58] Field of Search ..... 112/262.1, 269.1, 268.1, 112/441, 158 R, 81

[56] References Cited

U.S. PATENT DOCUMENTS 682,283 9/1901 Schneider ..... 112/268.1 X
2,448,495 8/1948 Muecke ..... 112/262.1
4,155,320 5/1979 Aubort ..... 112/269.1
4,250,824 2/1981 Meier et al. ..... 112/269.1
4,375,198 3/1983 Hanyu ..... 112/269.1

FOREIGN PATENT DOCUMENTS 308983 11/1918 Fed. Rep. of Germany ... 112/262.1

*Primary Examiner*—Werner H. Schroeder
*Assistant Examiner*—Andrew M. Falik
*Attorney, Agent, or Firm*—Michael J. Striker

[57] ABSTRACT

In a process of producing hemstitches by means of a zigzag sewing machine, in which straight stitches spaced from the edges of the fabrics to be sewn are formed, first zigzag stitches of a predetermined width are formed which extend between the edge of the fabrics and the straight stitches at a predetermined distance corresponding to the predetermined width of the zigzag stitches and secondly, zigzag stitches are formed which extend between the first zigzag stitches and the straight stitches. The second zigzag stitches formed are wider than the first zigzag stitches.

3 Claims, 7 Drawing Figures

ZIGZAG HEMSTITCH

BACKGROUND OF THE INVENTION

The invention relates to a method for producing hemstitches, especially by using a zigzag sewing machine forming lock stitches with an upper thread and a lower thread without using specific attachments or accessories.

In conventional methods of producing hemstitches by a zigzag sewing machine a series of seams are produced either inside of the edge of the fabric to be sewn or outside of the edge of the fabric.

SUMMARY OF THE INVENTION

It is an object of the present invention to provide an improved method of producing hemstitches by a zigzag sewing machine.

It is a further object of the invention to provide a method for producing attractive hemstitches by means of a zigzag sewing machine by forming the lock stitches with the upper and lower threads. It is another object of the invention to produce such hemstitches with a generally used zigzag stitching presser foot without using the other specific accessories or parts of the sewing machine.

According to the invention, the hemstitches are formed in a method comprising a process of forming stitches in parallel and inside of the edge of fabrics to be sewn up to actually connect the fabrics, a process of forming first zigzag stitches of a predetermined width between the edge of the fabrics and the stitches formed in parallel with the edge of the fabrics, and a process of forming second zigzag stitches between the first zigzag stitches and the stitches formed in parallel with the edge of the fabrics, the second zigzag stitches being wider than the first zigzag stitches.

DETAILED DESCRIPTION OF THE INVENTION

Figure 1:
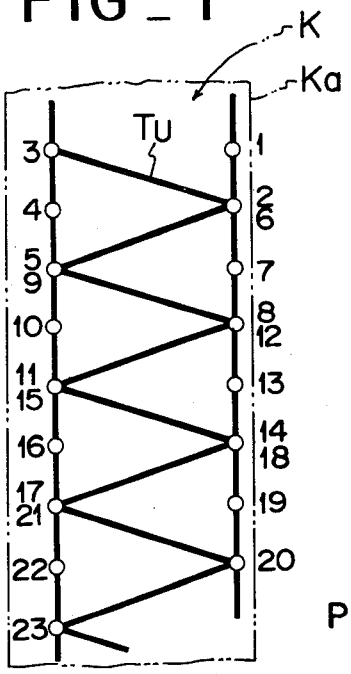
FIGS. 1–3 show conventional types of hemstitches which may be produced by using a zigzag sewing machine.
Figure 2:
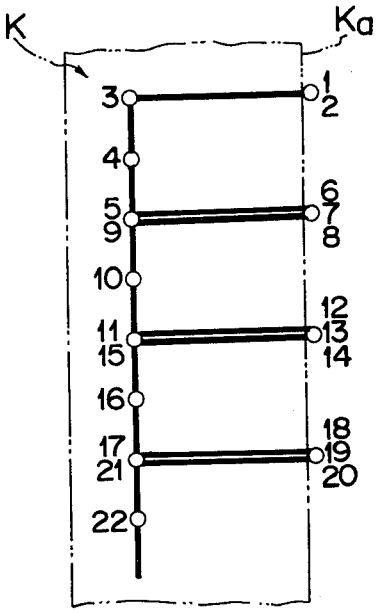
Prior Art FIG 2 Prior Art
Figure 3:
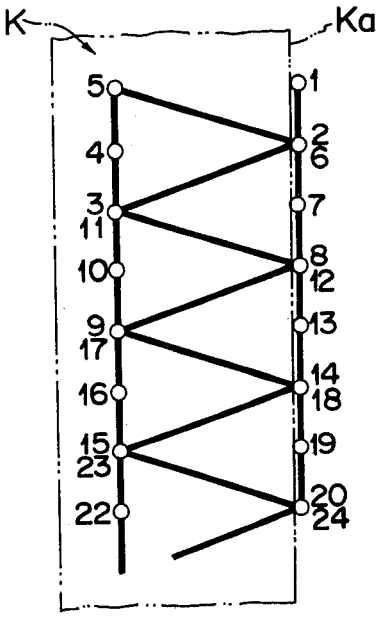
FIG 3 Prior Art

FIGS. 1 to 3 show the conventional hemstitches produced by a zigzag sewing machine, in which FIG. 1 shows the hemstitches having a series of seams at the right end thereof located inside of the edge (Ka) of the fabric (K) to be sewn. The interlocking points of an upper thread (Tu) and a lower thread (not shown) are shown by the marks "o" and the stitch formation sequence is shown by the numbers 1, 2, 3, . . . .

FIG. 2 shows the hemstitches of FIG. 1 having a series of seams at the right end thereof located outside of the edge (Ka) of the fabric (K). In the hemstitches, the seams at the right end tend to converge to one point respectively as shown, and as the result, the threads along the edge (Ka) of the fabric (K) are easily frayed. FIG. 3 shows the hemstitches having a series of seams at the right end thereof located outside of the edge (Ka) of the fabric. The hemstitches have threads each connected between the seams at the right end thereof along the fabric edge (Ka), but some seams 1, 7, 13, 19, . . . , are provided only for interlocking the upper thread (Tu) and the lower thread and will not consolidate the hemstitches.

An explanation will be made of the present invention with reference to FIGS. 4–7.

Figure 4:
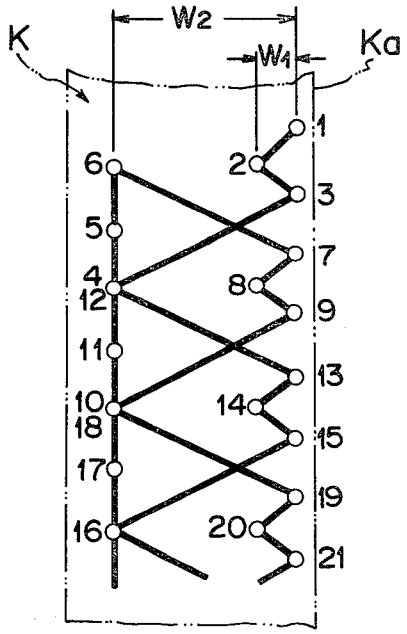
FIG. 4 shows a first embodiment of hemstitches in accordance with the invention.
Figure 5:
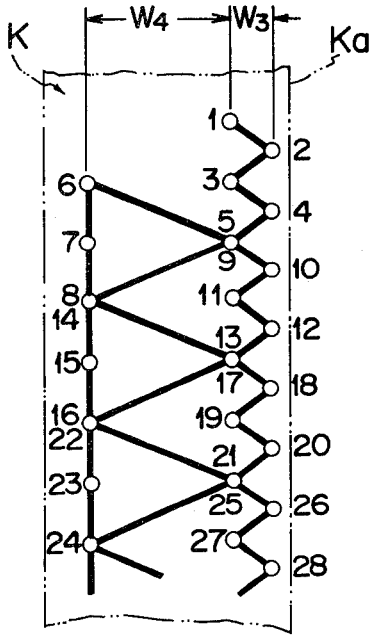
FIG. 5 shows a second embodiment of the invention.
Figure 6:
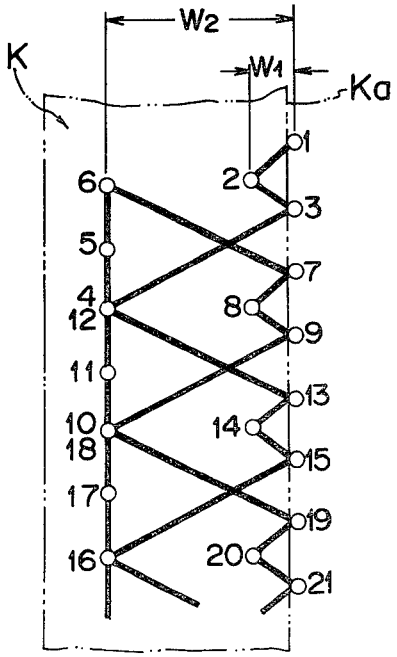
FIG. 6 shows a modified embodiment of the hemstitches of FIG. 4.
Figure 7:
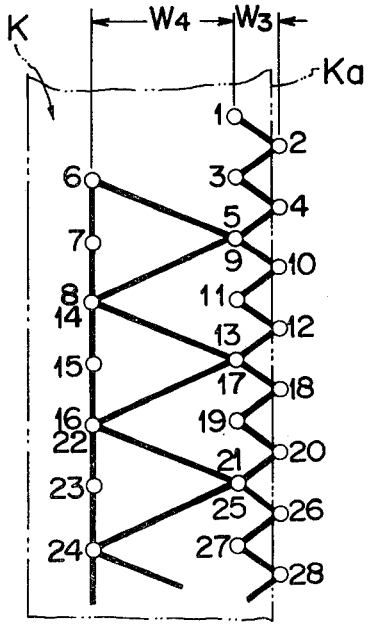
FIG. 7 shows a modified embodiment of the hemstitches of FIG. 5.

FIGS. 4 and 5 show first and second embodiments of hemstitches according to the invention, each having a series of seams at the right end side thereof located inside of the edge (Ka) of a fabric (K). FIG. 6 shows a third embodiment of hemstitches, which is the same type with the first embodiment in FIG. 4, but has a series of seams at the right end side thereof located outside of the edge (Ka) of the fabric (K). FIG. 7 shows a fourth embodiment of hemstitches, which is the same type with the second embodiment in FIG. 5, but has a series of seams at the right end side thereof located outside of the edge (Ka) of the fabric (K). The pattern of hemstitches in FIGS. 4 and 6 is formed up with a repetition of cyclic stitches 1–7, in which the stitches 1–4 are produced with the forward fabric feed while the needle is laterally swinging; the stitches 5 and 6 are produced with the backward fabric feed while the needle is vertically reciprocated without swinging movement, and the stitch 7 is produced with the forward fabric feed while the needle is swinging. In the pattern of hemstitches, the distance between the stitches 1 and 2 or 2 and 3 is represented by $W_1$ which is approximately 2 mm. The distance between the stitches 3 and 4 or 6 and 7 is represented by $W_2$ which is approximately 7 mm. The stitches 4, 5 and 6 form a line of straight stitches to actually connect two pieces of fabrics, which are opened out around the line of stitches.

The pattern of hemstitches in FIGS. 5 and 7 is formed up with a repetition of cyclic stitches 1–9, in which the stitches 1–5 are formed with the forward fabric feed while the needle is laterally swinging. The stitch 6 is formed with the backward fabric feed while the needle is laterally swinging, and the stitches 7 and 8 are formed with the forward fabric feed while the needle is vertically reciprocated without lateral swinging movement, and the stitch 9 is formed with the backward fabric feed while the needle is laterally swinging. In the pattern of hemstitches, the distance between the stitches 1 and 2 or 2 and 3 is represented by $W_3$ which is approximately 2 mm, and the distance between the stitches 5 and 6 or 8 and 9 is represented by $W_4$ which is approximately 5 mm. The stitches 6-7 form a line of straight stitches for actually connecting two pieces of fabrics, which are opened out around the line of stitches.

Thus in the pattern of hemstitches in FIGS. 4 and 6, the zigzag stitches (1, 2, 3), (7, 8, 9), (13, 14, 15), . . . , are formed to effectively hem the edge (Ka) of overlapped fabrics (K) while a line of stitches (4, 5, 6, 10, 11, 12, . . . ) are formed to actually connect the overlapped fabrics (K). Similarly in the pattern of hemstitches in FIGS. 5 and 7, the zigzag stitches (1, 2, 3), (4, 5, 10), (11, 12, 13), (18, 19, 20), . . . , are formed to effectively hem the edge (Ka) of overlapped fabrics (K) while a line of stitches (6, 7, 8, 14, 15, 16) . . . are formed to actually connect the overlapped fabrics (K). Namely, in FIGS. 4 and 6, the stitches 1 and 3; 7 and 9; . . . ; are consolidated by stitches 2 and 8 respectively to effectively hem the edge (Ka) of the overlapped fabrics (K), and in FIGS. 5 and 7 the stitches 2 and 4; 4 and 10; 10 and 12; . . . ; are consolidated by stitches 3, 5 and 11 respectively to effectively hem the edge (Ka) of the overlapped fabrics (K).

It will be understood that each of the elements described above, or two or more together, may also find useful application in other types of methods of producing hemstitches differing from the types described above.

While the invention has been illustrated and described as embodied in a method of producing hemstitches by zigzag sewing machines, it will be appreciated that various modifications and procedural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for producing hemstitches on a fabric by means of a zigzag sewing machine by forming lock stitches with an upper thread and a lower thread, wherein a series of straight stitches are formed in parallel with and spaced from the edge of the fabrics to be sewn up to connect at least two pieces of the fabrics, the method comprising the steps of forming first zigzag stitches of a predetermined width so that said first zigzag stitches extend between the edge of the fabrics and said straight stitches at a predetermined distance corresponding to said predetermined width; forming second zigzag stitches extending between said first zigzag stitches and said straight stitches, said second zigzag stitches having a number of seams on one side thereof connected to the first zigzag stitches and a number of seams on the opposite side thereof connected to said straight stitches.

2. The method as defined in claim 1, wherein said first zigzag stitches are formed inside of the edge of the fabrics.

3. The method as defined in claim 1, wherein said first zigzag stitches include a number of seams on one side thereof located outside of the edge of the fabrics.

* * * * *